US007314149B1

(12) United States Patent
White

(10) Patent No.: US 7,314,149 B1
(45) Date of Patent: Jan. 1, 2008

(54) APPARATUS FOR REMOTELY SUPPORTING AND OPERATING AN AEROSOL CANISTER

(76) Inventor: Wallace E. White, 179 Crown Point, Livingston, TX (US) 77351

( * ) Notice: Subject to any disclaimer, the term of this patent is extended or adjusted under 35 U.S.C. 154(b) by 348 days.

(21) Appl. No.: 11/087,433

(22) Filed: Mar. 24, 2005

(51) Int. Cl.
*B67D 5/64* (2006.01)

(52) U.S. Cl. ..... 222/174; 222/191; 222/192; 222/402.15

(58) Field of Classification Search ..... 222/174, 222/402.13, 402.15, 323, 473, 474, 191, 222/192; 239/531, 532, 375
See application file for complete search history.

(56) References Cited

U.S. PATENT DOCUMENTS 3,229,859 A * 1/1966 Conroy et al. ..... 222/174
4,092,000 A 5/1978 Offutt, III
4,660,745 A 4/1987 Hess, Jr.
5,307,959 A 5/1994 Bedore et al.
D355,824 S 2/1995 Smrt
5,518,148 A 5/1996 Smrt
5,540,359 A 7/1996 Gobbel

* cited by examiner

*Primary Examiner*—J. Casimer Jacyna

(57) ABSTRACT

An apparatus to discharge an aerosol canister in remotely located places includes a handle that has axially opposed end portions wherein the proximal end portion detachably receives an auxiliary support pole. The handle further includes an eyelet laterally extending away therefrom and situated adjacent to the proximal end portion. An elongated arm formed from deformably resilient material has axially offset end portions secured to the distal end portion of the handle and positioned distally therefrom respectively. A mechanism is included for pivoting the arm in such a manner that the arm is engaged and disengaged with a spray nozzle of the aerosol canister. A support assembly is fastened to the arm in so that the support assembly maintains the aerosol canister at a static position when the arm is toggled between the engaged and disengaged positions, wherein the user can discharge the aerosol canister contents without directly contacting the nozzle.

15 Claims, 3 Drawing Sheets

APPARATUS FOR REMOTELY SUPPORTING AND OPERATING AN AEROSOL CANISTER

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to aerosol canister supporting apparatuses and, more particularly, to an apparatus for remotely supporting and operating an aerosol canister.

2. Prior Art

Spray cans are popular dispensers for spraying a wide variety of materials. In recent years, spray cans have been widely used for dispensing insecticides and pesticides. A building includes surfaces where wasps and/or spiders tend to build their nests and make homes that are too high to be reached by a person holding a spray can of insecticide/pesticide in their hand. In this respect, either a ladder must be used, or a device must be used to essentially extend the length of the person's arms to apply insecticide/pesticide from the spray can at otherwise out of reach locations.

Many people seek to avoid the use of ladders for a number of reasons. They are expensive, they are heavy and difficult to raise and lower, and they may be dangerous. One always runs the risk of falling off of the ladder and being subjected to serious injury. A further concern is that the inhabitants of the wasp nest may become agitated and attempt to sting the person trying to spray them. This could lead to a painful, or deadly sting if allergic, or to the person becoming startled and falling off of the ladder.

Accordingly, a need remains for an apparatus for remotely supporting and operating an aerosol canister in order to overcome the above-noted shortcomings. The present invention satisfies such a need by providing an aerosol canister supporting apparatus that is small for easy storage, has a sufficiently long reach, and improves a person's safety when used. When set up, the aerosol dispenser easily reaches most household roofs, and tree-suspended stinging insect nests etc., from the ground. In use, it enables pesticides/insecticides to be more accurately and efficiently applied. The aerosol dispenser also enables the user to remain a greater distance away, thereby minimizing their chances of being bitten, stung, or negatively affected by the pesticides/insecticides.

BRIEF SUMMARY OF THE INVENTION

In view of the foregoing background, it is therefore an object of the present invention to provide an apparatus for remotely supporting and operating an aerosol canister. These and other objects, features, and advantages of the invention are provided by an apparatus for assisting a user to discharge an aerosol canister in remotely located and hard-to-reach places.

The apparatus includes an elongated handle that has axially opposed proximal and distal end portions wherein the proximal end portion is sized and shaped for detachably receiving an auxiliary support pole and maintaining a static relationship therewith during operating conditions. Such a handle further includes an eyelet laterally extending away therefrom and situated adjacent to the proximal end portion wherein the eyelet defines an opening extending parallel to the handle.

An elongated arm is formed from deformably resilient material that has axially offset proximal and distal end portions secured to the distal end portion of the handle and positioned distally therefrom respectively. Such an arm preferably has monolithically formed top, bottom and central regions. The top region and the bottom region are oriented parallel to the vertical axis. The central region extends along a plane oblique to the vertical axis and the top region is axially offset from the bottom region.

A mechanism is included for resiliently pivoting the arm in such a manner that the arm is effectively engaged and disengaged with a spray nozzle of the aerosol canister respectively. Such a pivoting mechanism preferably includes an elongated actuator member that has a substantially planar bottom surface and monolithically formed sides upwardly extending therefrom in such a manner that the actuator member defines a U-shaped channel through which a selected portion of the arm passes. The actuator member is pivotally connected to the arm and has proximal and distal end portions. Such a distal end portion of the actuator member is preferably engageable with the arm subjacent to the distal end portion thereof. The pivoting mechanism may further have a fulcrum axis medially defined at the central portion of the arm.

A cord having opposed end portions is removably secured to the proximal end portion of the actuator member and positioned through the eyelet in such a manner that the cord extends downwardly parallel to the handle and the auxiliary pole so that the user can readily grasp and tug on the cord when desiring to pivot the arm and activate the aerosol canister.

A support assembly is operably fastened to the arm in such a manner that the support assembly conveniently maintains the aerosol canister at a static position when the arm is toggled between the engaged and disengaged positions during operating conditions. Such a support assembly is spaced from the distal end portion of the arm. The user can advantageously selectively discharge contents housed within the aerosol canister without directly contacting the nozzle of the aerosol canister.

The support assembly preferably includes a support member secured to the arm and has a first portion registered with a pivot axis of the pivoting mechanism. Such a support member further has a second portion monolithically formed with the first portion and extending orthogonal thereto along a horizontal plane. The second portion is sized and shaped for receiving a major longitudinal length of the aerosol canister thereon. A plurality of clamps are adjustably positioned about the aerosol canister and fastened to the second portion in such a manner that the aerosol canister can advantageously be maintained at a substantially stable position during operating conditions.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
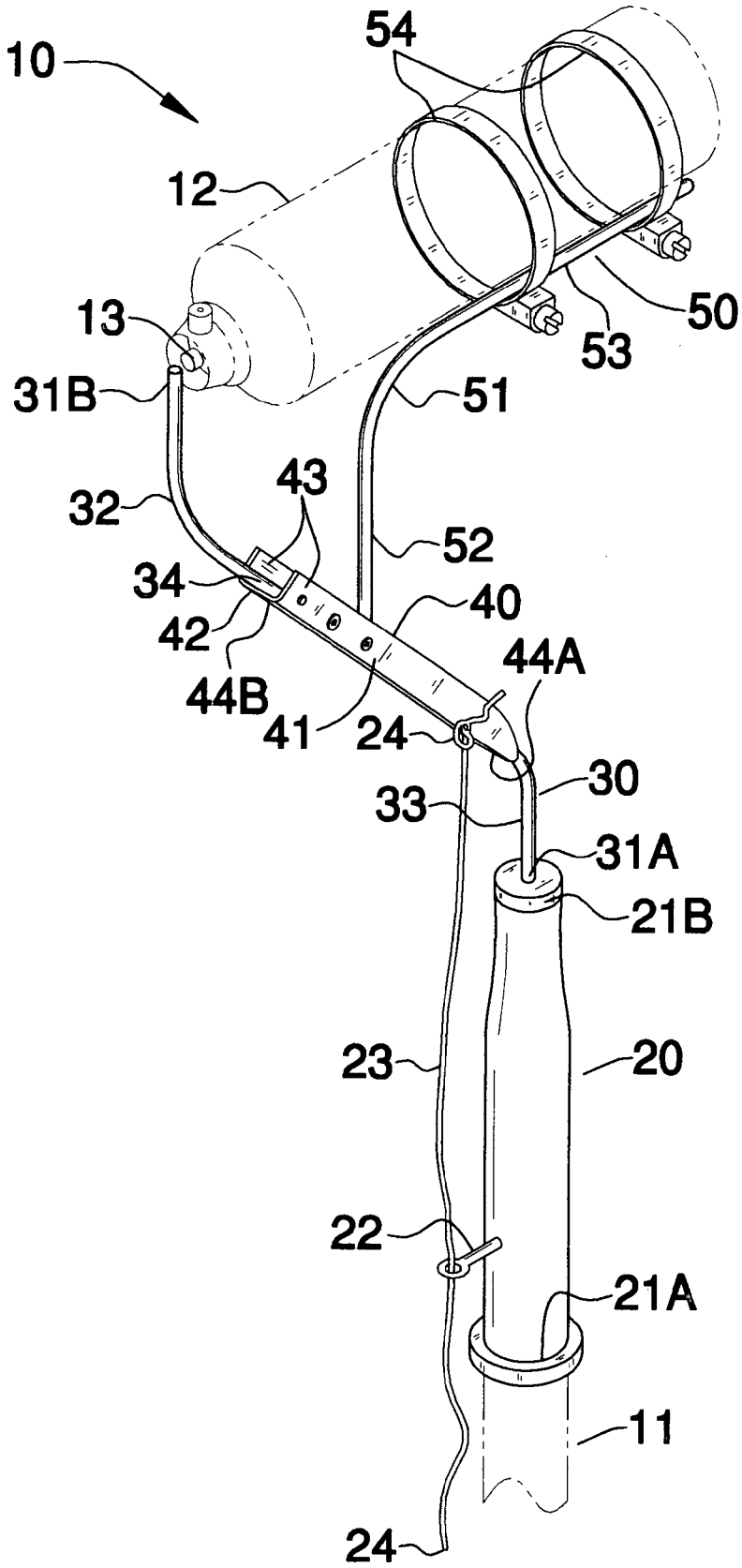
FIG. 1 is a perspective view showing an apparatus for remotely supporting and operating an aerosol canister, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1-5 by the reference numeral 10 and is intended to provide an apparatus for remotely supporting and operating an aerosol canister. It should be understood that the apparatus 10 may be used to support and operate many different types of aerosol canisters and should not be limited in use to only pesticide/insecticide canisters.

Referring initially to FIG. 1, the apparatus 10 includes an elongated handle 20 that has axially opposed proximal 21A and distal 21B end portions wherein the proximal end portion 21A is sized and shaped for detachably receiving an auxiliary support pole 11 and maintaining a static relationship therewith during operating conditions. Of course, such a support pole 11 can be provided with the apparatus 10 or be supplied by the user themselves, and may have various lengths as need requires, as is obvious to a person of ordinary skill in the art. Such a handle 20 further includes an eyelet 22 laterally extending away therefrom and situated adjacent to the proximal end portion 21A wherein the eyelet 22 defines an opening extending parallel to the handle 20.

Figure 2:
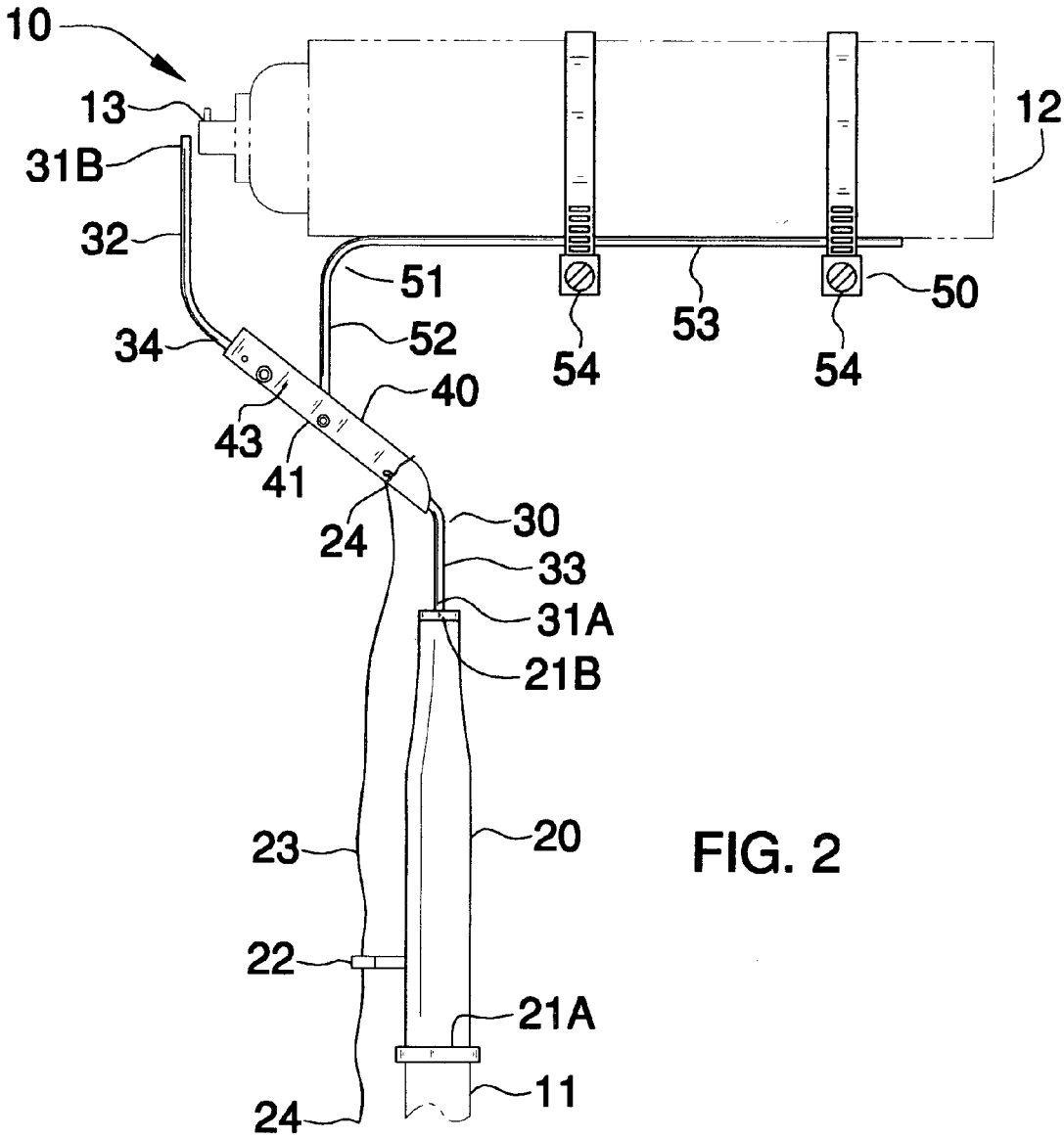
FIG. 2 is a side-elevational view of the apparatus shown in FIG. 1.
Figure 4:
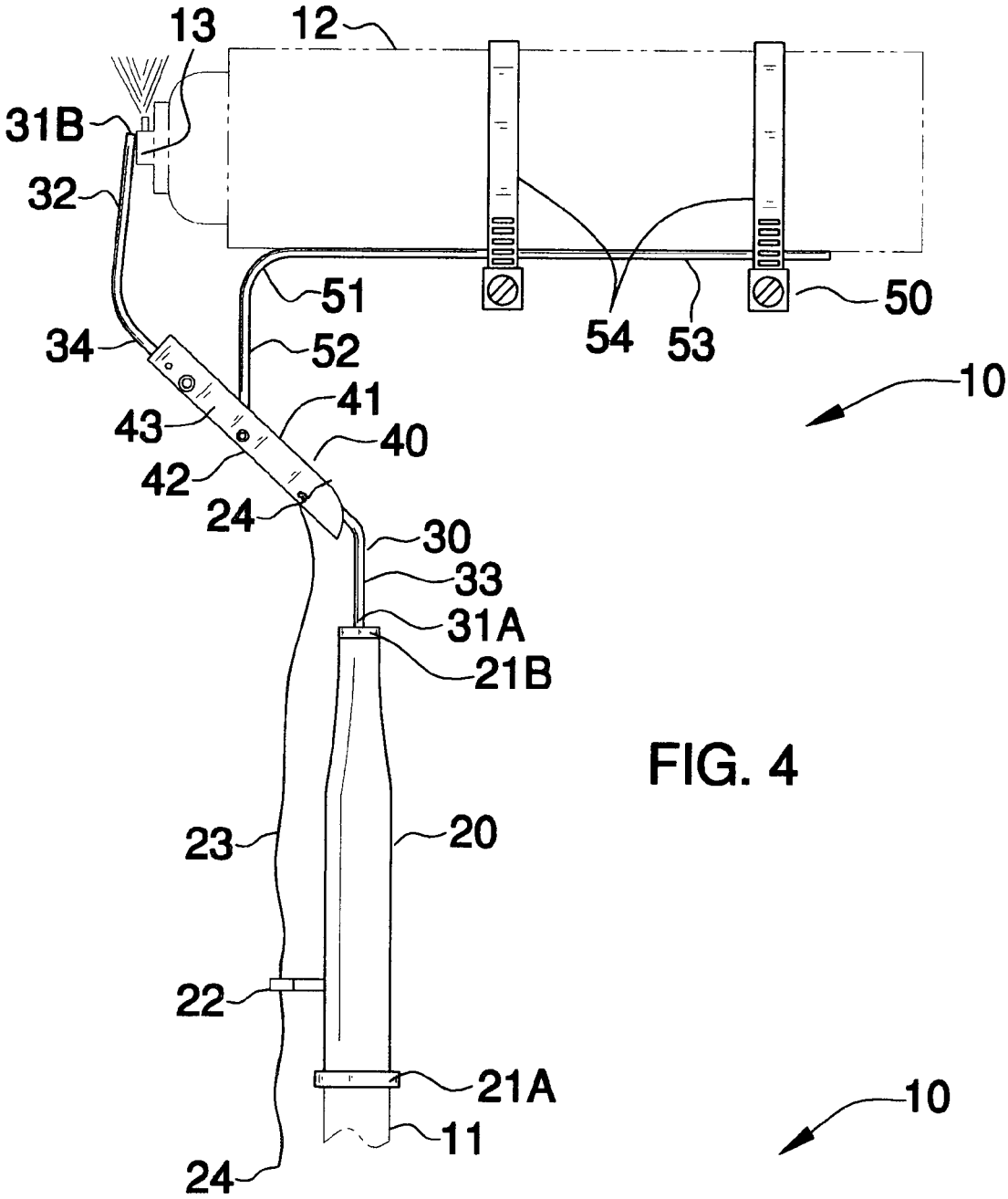
FIG. 4 is a side elevational view of the apparatus shown in FIG. 1, showing the actuator member engaged with the aerosol canister.

Referring to FIGS. 1, 2, and 4, an elongated arm 30 is formed from deformably resilient material that has axially offset proximal 31A and distal 31B end portions secured to the distal end portion 21B of the handle 20 and positioned distally therefrom respectively. Such an arm 30 has monolithically formed top 32, bottom 33 and central regions 34. The top region 32 and the bottom region 33 are oriented parallel to the vertical axis. The central region 34 extends along a plane oblique to the vertical axis, and the top region 32 is axially offset from the bottom region 33.

Still referring to FIGS. 1, 2, and 4, an essential mechanism 40 is included for resiliently pivoting the arm 30 in such a manner that the arm 30 is effectively engaged and disengaged with a spray nozzle 13 of the aerosol canister 12 respectively. Such a pivoting mechanism 40 includes an elongated actuator member 41 that has a substantially planar bottom surface 42 and monolithically formed sides 43 upwardly extending therefrom in such a manner that the actuator member 41 defines a U-shaped channel through which a selected portion of the arm 30 passes. The actuator member 41 is pivotally connected to the arm 30 and has proximal 44A and distal 44B end portions. Such a distal end portion 44B of the actuator member 41 is engageable with the arm 30 subjacent to the distal end portion 31B thereof. The pivoting mechanism 40 further has a fulcrum axis medially defined at the central portion 34 of the arm 30.

Again referring to FIGS. 1, 2 and 4, a cord 23 has opposed end portions 24 removably secured to the proximal end portion 44B of the actuator member 41 and positioned through the eyelet 22 in such a manner that the cord 23 extends downwardly parallel to the handle 20 and the auxiliary pole 11 so that the user can readily grasp and tug on the cord 23 when desiring to pivot the arm 30 and activate the aerosol canister 12. The cord 23 is important for allowing the apparatus 10 to be operated in a remote fashion, which advantageously allows the user to remain isolated from the area that is to be sprayed.

Figure 3:
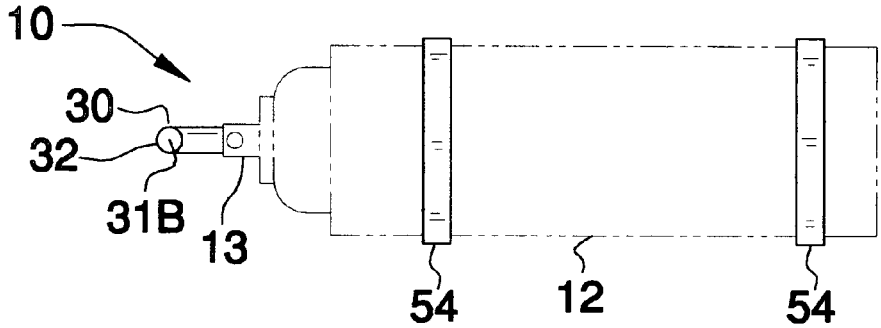
FIG. 3 is a top plan view of the apparatus shown in FIG. 1.
Figure 5:
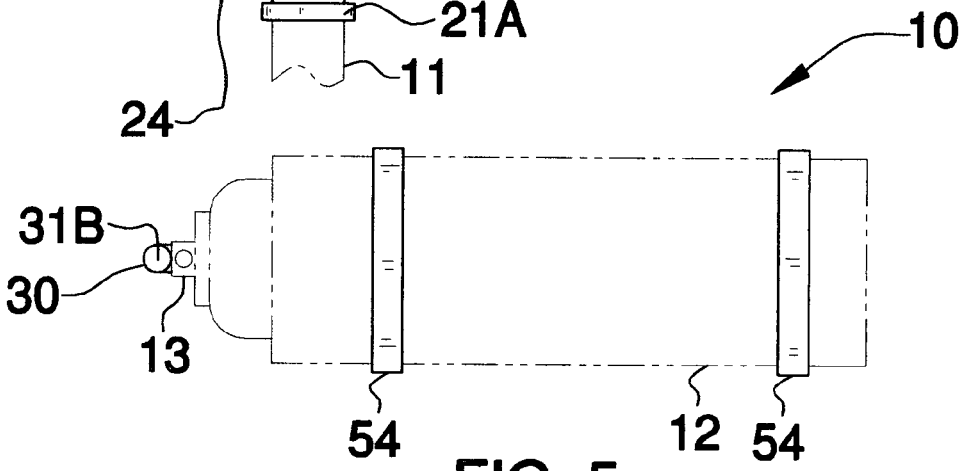
FIG. 5 is a top plan view of the apparatus shown in FIG. 4.

Referring to FIGS. 1 through 5, a support assembly 50 is operably fastened to the arm 30 in such a manner that the support assembly 50 conveniently maintains the aerosol canister 12 at a static position when the arm 30 is toggled between the engaged and disengaged positions during operating conditions, as is best shown in FIGS. 3 and 5. Such a support assembly 50 is spaced from the distal end portion 31B of the arm 30. The user can advantageously selectively discharge contents housed within the aerosol canister 12 without directly contacting the nozzle 13 of the aerosol canister 12, thus eliminating the chances of accidentally depositing harmful insecticides/pesticides on their hands.

Still referring to FIGS. 1 through 5, the support assembly 50 includes a support member 51 secured to the arm 30 and has a first portion 52 registered with a pivot axis of the pivoting mechanism 40. Such a support member 51 further has a second portion 53 monolithically formed with the first portion 52 and extending orthogonal thereto along a horizontal plane. The second portion 53 is sized and shaped for receiving a major longitudinal length of the aerosol canister 12 thereon. Of course, such a second portion 53 may be sized to have various lengths, so as to support a variety of differently sized aerosol canisters 12, as is obvious to a person of ordinary skill in the art. A plurality of clamps 54 are adjustably positioned about the aerosol canister 12 and fastened to the second portion 53 in such a manner that the aerosol canister 12 can advantageously be maintained at a substantially stable position during operating conditions. Furthermore, such adjustable clamps 54 are vital for allowing the support assembly 50 to effectively receive alternately sized and shaped aerosol canisters 12.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. An apparatus for assisting a user to discharge an aerosol canister in remotely located and hard-to-reach places, said apparatus comprising:

an elongated handle having axially opposed proximal and distal end portions wherein said proximal end portion is sized and shaped for detachably receiving an auxiliary support pole and maintaining a static relationship therewith during operating conditions, said handle further including an eyelet laterally extending away therefrom and situated adjacent said proximal end portion wherein said eyelet defines an opening extending parallel to said handle;

an elongated arm having axially offset proximal and distal end portions secured to said distal end portion of said handle and positioned distally therefrom respectively;

means for resiliently pivoting said arm in such a manner that said arm is engaged and disengaged with a spray nozzle of the aerosol canister respectively; and a support assembly operably fastened to said arm in such a manner that said support assembly maintains said aerosol canister at a static position when said arm is toggled between the engaged and disengaged positions during operating conditions;

wherein the user can selectively discharge contents housed within the aerosol canister without directly contacting the nozzle of the aerosol canister;

wherein said pivoting means comprises an elongated actuator member having a substantially planar bottom surface and monolithically formed sides upwardly extending therefrom in such a manner that said actuator member defines a U-shaped channel through which a selected portion of said arm passes, said actuator member being pivotally connected to said arm and having proximal and distal end portions; and a cord having opposed end portions removably secured to said proximal end portion of said actuator member and positioned through said eyelet in such a manner that said cord extends downwardly parallel to said handle and the auxiliary pole so that the user can readily grasp and tug on said cord when desiring to pivot said arm and activate said aerosol canister.

2. The apparatus of claim 1, wherein said arm has monolithically formed top, bottom and central regions, said top region and said bottom region being oriented parallel to the vertical axis, said central region extending along a plane oblique to the vertical axis, said top region being axially offset from said bottom region.

3. The apparatus of claim 1, wherein said support assembly comprises:

a support member secured to said arm and having a first portion registered with a pivot axis of said pivoting means, said support member further having a second portion monolithically formed with said first portion and extending orthogonal thereto along a horizontal plane, said second portion being sized and shaped for receiving a major longitudinal length of the aerosol canister thereon; and a plurality of clamps adjustably positioned about the aerosol canister and fastened to said second portion in such a manner that said aerosol canister can be maintained at a substantially stable position during operating conditions.

4. The apparatus of claim 2, wherein said pivoting means has a fulcrum axis medially defined at said central portion of said arm.

5. The apparatus of claim 1, said distal end portion of said actuator member being engageable with said arm and subjacent said distal end portion thereof.

6. An apparatus for assisting a user to discharge an aerosol canister in remotely located and hard-to-reach places, said apparatus comprising:

an elongated handle having axially opposed proximal and distal end portions wherein said proximal end portion is sized and shaped for detachably receiving an auxiliary support pole and maintaining a static relationship therewith during operating conditions, said handle further including an eyelet laterally extending away therefrom and situated adjacent said proximal end portion wherein said eyelet defines an opening extending parallel to said handle;

an elongated arm formed from deformably resilient material and having axially offset proximal and distal end portions secured to said distal end portion of said handle and positioned distally therefrom respectively;

means for resiliently pivoting said arm in such a manner that said arm is engaged and disengaged with a spray nozzle of the aerosol canister respectively; and a support assembly operably fastened to said arm in such a manner that said support assembly Maintains said aerosol canister at a static position when said arm is toggled between the engaged and disengaged positions during operating conditions;

wherein the user can selectively discharge contents housed within the aerosol canister without directly contacting the nozzle of the aerosol canister;

wherein said pivoting means comprises an elongated actuator member having a substantially planar bottom surface and monolithically formed sides upwardly extending therefrom in such a manner that said actuator member defines a U-shaped channel through which a selected portion of said arm passes, said actuator member being pivotally connected to said arm and having proximal and distal end portions; and a cord having opposed end portions removably secured to said proximal end portion of said actuator member and positioned through said eyelet in such a manner that said cord extends downwardly parallel to said handle and the auxiliary pole so that the user can readily grasp and tug on said cord when desiring to pivot said arm and activate said aerosol canister.

7. The apparatus of claim 6, wherein said arm has monolithically formed top, bottom and central regions, said top region and said bottom region being oriented parallel to the vertical axis, said central region extending along a plane oblique to the vertical axis, said top region being axially offset from said bottom region.

8. The apparatus of claim 6, wherein said support assembly comprises:

a support member secured to said arm and having a first portion registered with a pivot axis of said pivoting means, said support member further having a second portion monolithically formed with said first portion and extending orthogonal thereto along a horizontal plane, said second portion being sized and shaped for receiving a major longitudinal length of the aerosol canister thereon; and a plurality of clamps adjustably positioned about the aerosol canister and fastened to said second portion in such a manner that said aerosol canister can be maintained at a substantially stable position during operating conditions.

9. The apparatus of claim 7, wherein said pivoting means has a fulcrum axis medially defined at said central portion of said arm.

10. The apparatus of claim 6, said distal end portion of said actuator member being engageable with said arm and subjacent said distal end portion thereof.

11. An apparatus for assisting a user to discharge an aerosol canister in remotely located and hard-to-reach places, said apparatus comprising:

an elongated handle having axially opposed proximal and distal end portions wherein said proximal end portion is sized and shaped for detachably receiving an auxiliary support pole and maintaining a static relationship therewith during operating conditions, said handle further Including an eyelet laterally extending away therefrom and situated adjacent said proximal end portion wherein said eyelet defines an opening extending parallel to said handle;

an elongated arm formed from deformably resilient material and having axially offset proximal and distal end portions secured to said distal end portion of said handle and positioned distally therefrom respectively;

means for resiliently pivoting said arm in such a manner that said arm is engaged and disengaged with a spray nozzle of the aerosol canister respectively; and a support assembly operably fastened to said arm in such a manner that said support assembly maintains said aerosol canister at a static position when said arm is toggled between the engaged and disengaged positions during operating conditions, said support assembly being spaced from said distal end portion of said arm;

wherein the user can selectively discharge contents housed within the aerosol canister without directly contacting the nozzle of the aerosol canister;

wherein said pivoting means comprises an elongated actuator member having a substantially planar bottom surface and monolithically formed sides upwardly extending therefrom in such a manner that said actuator member defines a U-shaped channel through which a selected portion of said arm passes, said actuator member being pivotally connected to said arm and having proximal and distal end portions; and a cord having opposed end portions removably secured to said proximal end portion of said actuator member and positioned through said eyelet in such a manner that said cord extends downwardly parallel to said handle and the auxiliary Dole so that the user can readily grasp and tug on said cord when desiring to pivot said arm and activate said aerosol canister.

12. The apparatus of claim 11, wherein said arm has monolithically formed top, bottom and central regions, said top region and said bottom region being oriented parallel to the vertical axis, said central region extending along a plane oblique to the vertical axis, said top region being axially offset from said bottom region.

13. The apparatus of claim 11, wherein said support assembly comprises:

a support member secured to said arm and having a first portion registered with a pivot axis of said pivoting means, said support member further having a second portion monolithically formed with said first portion and extending orthogonal thereto along a horizontal plane, said second portion being sized and shaped for receiving a major longitudinal length of the aerosol canister thereon; and a plurality of clamps adjustably positioned about the aerosol canister and fastened to said second portion in such a manner that said aerosol canister can be maintained at a substantially stable position during operating conditions.

14. The apparatus of claim 12, wherein said pivoting means has a fulcrum axis medially defined at said central portion of said arm.

15. The apparatus of claim 13, said distal end portion of said actuator member being engageable with said arm and subjacent said distal end portion thereof.

* * * * *